US008312984B2

(12) United States Patent
Scott

(10) Patent No.: US 8,312,984 B2
(45) Date of Patent: Nov. 20, 2012

(54) DEVICE FOR FILLING OF CONTAINERS

(75) Inventor: Mikael Scott, Limhamn (SE)

(73) Assignee: Ecolean Research & Development A/S, Copenhagen (DK)

( * ) Notice: Subject to any disclaimer, the term of this patent is extended or adjusted under 35 U.S.C. 154(b) by 57 days.

(21) Appl. No.: 13/001,700

(22) PCT Filed: Jun. 18, 2009

(86) PCT No.: PCT/SE2009/050764

§ 371 (c)(1),
(2), (4) Date: Dec. 28, 2010

(87) PCT Pub. No.: WO2010/002334

PCT Pub. Date: Jan. 7, 2010

(65) Prior Publication Data

US 2011/0107730 A1 May 12, 2011

(30) Foreign Application Priority Data

Jul. 2, 2008 (SE) ..... 0801568

(51) Int. Cl.
*B65G 29/00* (2006.01)

(52) U.S. Cl. ..... 198/465.4; 198/685; 53/570

(58) Field of Classification Search ..... 198/465.4, 198/678.1, 680, 683–687; 53/567, 570
See application file for complete search history.

(56) References Cited

U.S. PATENT DOCUMENTS

| | | | | |
|---|---|---|---|---|
| 4,674,266 | A | 6/1987 | Araki | |
| 5,086,609 | A * | 2/1992 | Tetenborg | 53/452 |
| 5,878,553 | A | 3/1999 | Schlosser | |
| 6,401,439 | B1 | 6/2002 | Tetenborg et al. | |
| 7,770,362 | B2 * | 8/2010 | Koehn | 53/459 |

FOREIGN PATENT DOCUMENTS

| | | | |
|---|---|---|---|
| GB | 1308786 | A | 3/1973 |
| WO | 99/41149 | A1 | 8/1999 |

OTHER PUBLICATIONS

International Search Report: PCT/SE2009/050764.

* cited by examiner

*Primary Examiner* — James R Bidwell
(74) *Attorney, Agent, or Firm* — Ladas & Parry LLP

(57) ABSTRACT

Apparatus for filling packages of the collapsible type, having a first station and a second station, a transport unit for intermittent transport of the packages from the first station to the second station along a transport direction (P) which extends between the first station and the second station, the transport unit being designed to transport the packages in a hanging position, and a swing-inhibiting unit which is designed to engage with the packages in order to counteract a swinging movement of the hanging packages during said transport, the swing-inhibiting unit being movable along the transport direction (P) while the transport unit transports the packages. The swing-inhibiting unit is arranged separately from the tranport unit.

10 Claims, 5 Drawing Sheets

DEVICE FOR FILLING OF CONTAINERS

TECHNICAL FIELD

The present invention relates to an apparatus for filling containers or packages, and more particularly to such an apparatus designed for filling packages of the collapsible type.

BACKGROUND ART

It has become increasingly common to package liquid products, particularly liquid food products such as water, milk, juice or wine, in packages of the collapsible type.

A package of the collapsible type means a package with a chamber which is defined by flexible walls and whose volume is dependent on the mutual position of the walls.

Before being filled, this type of package can be in a flat and sealed state. This makes it possible to sterilize the chamber of the package at the time of manufacture and, with the sterility maintained, to distribute the package to a filling plant, such as a dairy.

It is known to produce rolls made up of interconnected packages of the abovementioned type rolled up on a bobbin and to arrange such a roll in a filling machine.

Such a filling machine is known, for example, from WO99/41149. The document describes how the rolled-out web of package blanks is fed through the filling machine so as to arrive, in the proper order, at a station for cutting open a filling channel, at a filling station for filling each package, and at a sealing station for sealing the filled packages.

A filling machine usually represents quite a considerable investment and, for this reason, there is a need for filling machines of simple construction and also for filling machines with a high filling capacity, i.e. filling machines capable of filling quite a large number of packages per unit of time.

There is also a need for such filling machines of high capacity that are able to fill the packages under hygienic conditions, especially if the filling machine is designed for aseptic filling of the packages. For filling to take place under hygienic conditions, it is necessary for spills and splashes to be eliminated or in any event reduced.

U.S. Pat. No. 4,674,266 A discloses an apparatus comprising stations for opening, filling and sealing of bags. The apparatus comprises a transport unit for moving the bags between stations. The transport unit in turn comprises gripping elements that carry plates extending downward. The gripping elements are designed to grip side portions of the packages. The plates are intended to prevent a swinging movement of the bags. This solution, however, has a number of disadvantages. First, the ability to attenuate the swinging movements is limited, which results in problems with spills and splashes. Moreover, the plates make rapid gripping of the bags difficult, which has a negative effect on the speed of production.

SUMMARY OF THE INVENTION

In view of the above, it is an object of the present invention to make available an apparatus which, with high capacity, is able to fill packages of the collapsible type.

It is also an object to make available an apparatus of this kind that is able to fill packages under hygienic conditions.

A further object is to make available an apparatus for filling packages of the collapsible type that is of a simple and reliable construction.

To achieve these objects, and also other objects that will become evident from the following description, the present invention provides an apparatus for filling packages of the collapsible type.

More specifically, according to the present invention, an apparatus for filling packages of the collapsible type is provided, comprising a first station and a second station, a transport unit for intermittent transport of said packages from the first station to the second station along a transport direction which extends between the first station and the second station, the transport unit being designed to transport the packages in a hanging position, and a swing-inhibiting unit which is designed to engage with said packages in order to counteract a swinging movement of the hanging packages during said transport, said swing-inhibiting unit being movable along said transport direction while the transport unit transports the packages, and the swing-inhibiting unit being arranged separately from the transport unit.

An apparatus of simple and reliable construction is thus provided for filling packages of the collapsible type. This apparatus also allows packages of the collapsible type to be filled at high capacity and under hygienic conditions.

By virtue of the fact that the swing-inhibiting unit is arranged separately from the transport unit, the swing-inhibiting unit can easily be made to engage with the respective package at any chosen point. It may be advantageous in many cases for the engagement to be made with the bottom portions of the packages, so as to attenuate the swinging movement to the maximum extent, which allows a high rate of production. The fact that the swing-inhibiting unit is arranged separately from the transport unit also means that the transport unit can easily be made to grip the respective package unimpeded, which also favours a high rate of production.

The first station can be a filling station at which a filling tube is introduced into a filling channel of the respective package in order to subsequently fill the package. The second station can be a sealing station for closing the filled package. It is also within the scope of the invention to provide other or additional stations. Consequently, the apparatus according to the invention can comprise an opening station with suction cups that can be brought into engagement with side wall portions of the packages. By means of subsequent separation of the suction cups, while the engagement is maintained through the suction effect, a separation of said side wall portions can be produced in order to open said filling channel. The apparatus can also comprise a gas filling station for filling a handle part of the package with gas, or a gas sealing station for sealing a gas-filled handle part. In the case where other or additional stations are provided, the transport unit can be designed for intermittent transport of the packages also to these other or additional stations.

The package and the swing-inhibiting unit do not have to be moved only in said transport direction, and instead other movement components may be provided, and this can be achieved, for example, by moving the packages along a curved path of movement.

It may be sufficient for the swinging movement to be attenuated rather than eliminated. It will be appreciated that there can be stations for which no inhibition of a swinging movement is provided.

The swing-inhibiting unit can be designed to counteract a swinging movement in a plane that is defined by the direction of gravity and the transport direction.

The transport unit can be designed to transport the packages between the first station and the second station along a curved first path of movement.

The transport unit can also comprise a gripping element which is movable along a circular path and which is designed to grip a top portion of a package, each gripping element, during movement along a work portion of said circular path, serving to transport a package along said first path of movement and, during movement along a return portion of said circular path, being designed to return to a starting position for gripping a new package.

The swing-inhibiting unit can be movable along a curved second path of movement. Said second path of movement can be curved in the same direction as said first path of movement.

Said second path of movement can be open, the swing-inhibiting unit being designed to perform a reciprocating movement along said second path of movement and the first station being arranged at a first end position of said open second path of movement and the second station being arranged at a second end position of said open second path of movement. This type of reciprocating movement ensures that the engagement element engages gently with the packages during operation. This counteracts spills resulting from the swing-inhibiting units striking against the packages.

The swing-inhibiting unit can be designed to partially support said packages during said transport. By the swing-inhibiting unit being designed to only partially support said packages during transport, it is possible to ensure that a filled, unsealed package is not pressed together in such a way that its free headspace volume becomes so small that there is a risk of spillage. At the same time, the fact that the packages are partially supported by the swing-inhibiting unit allows an effective attenuation of swinging movements.

Said swing-inhibiting unit can comprise engagement elements, each of which comprises a pair of engagement surfaces that are angled away from each other and that are designed to engage with a bottom portion of said packages. Each engagement element then has a V-shaped configuration. The abovementioned engagement surfaces angled away from each other reduce the lateral play during transport and in this way effectively counteract a swinging movement of the hanging packages during said transport.

BRIEF DESCRIPTION OF THE DRAWINGS

Embodiments of the present invention will be described below by way of example and with reference to the accompanying drawings.

DESCRIPTION OF EMBODIMENTS

Figure 1:
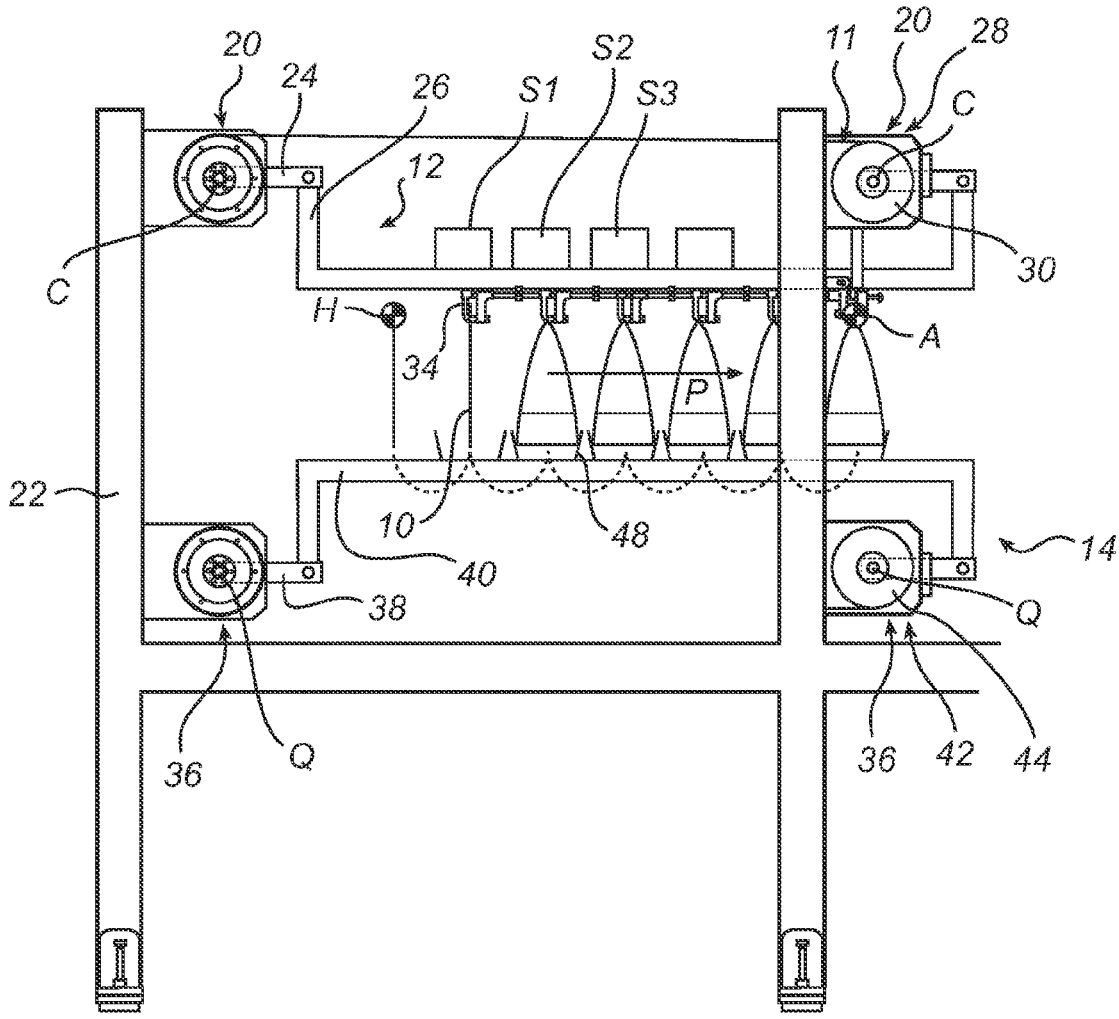
FIG. 1 shows an apparatus according to the invention for filling packages 2 of the collapsible type.

FIG. 1, to which reference is now made, shows an apparatus according to the invention for filling packages 10 of the collapsible type.

The packages 10 can be made from a laminated film material.

Each package 10 can have a chamber which is defined by two opposite side walls and a bottom wall and whose volume is dependent on the mutual position of the flexible walls.

The packages 10 can be provided in an interconnected state and rolled up on a bobbin. In the apparatus according to the invention for filling the packages, the latter are rolled out and separated from one another.

The packages 10 can be provided in a flat and closed state. This ensures that packages 10 that have been sterilized at the time of manufacture can be distributed in this sterile condition to a filling plant, such as a dairy.

The apparatus shown in FIG. 1 comprises a first station S1, a second station S2 and a third station S3, which are arranged in succession, and a transport unit 12 and a swing-inhibiting unit 14.

Figure 2A:
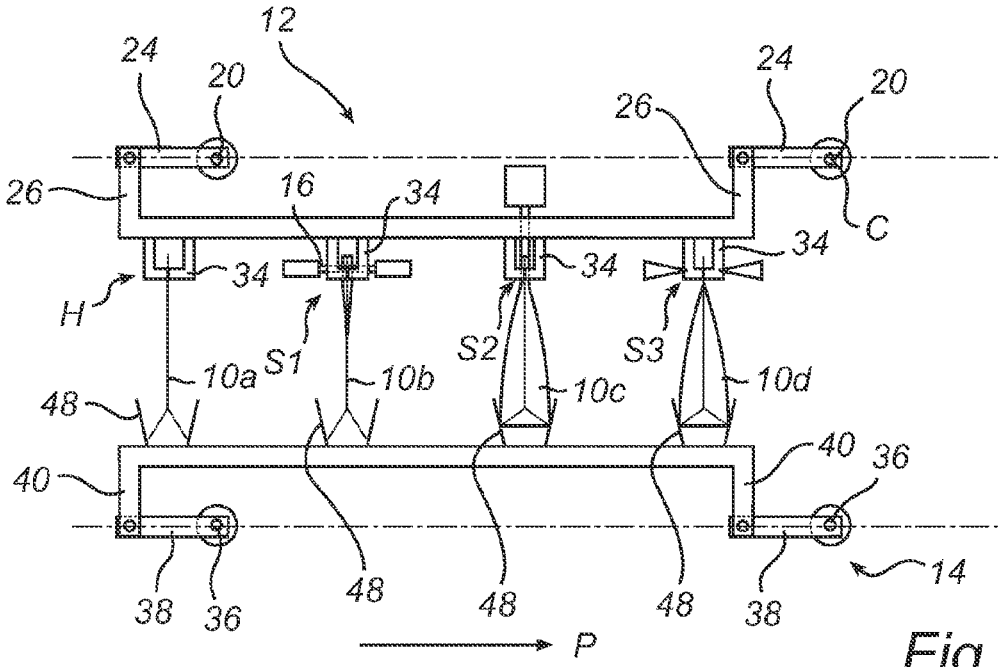
FIGS. 2*a*-*h* show schematic side views of an apparatus according to the invention in different operating states.
Figure 2B:
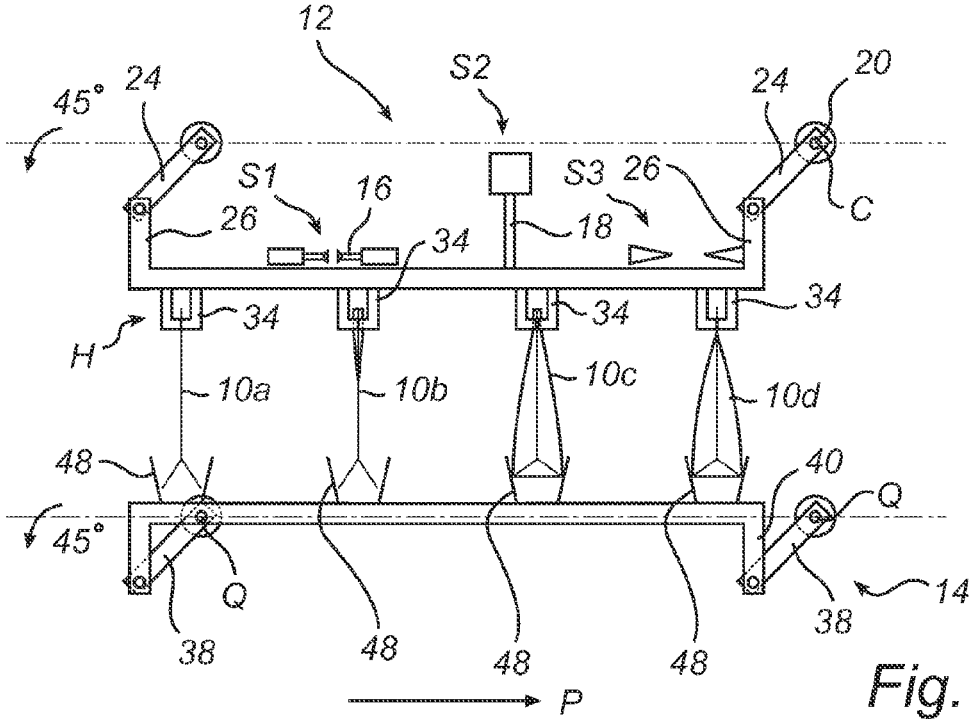
Figure 2C:
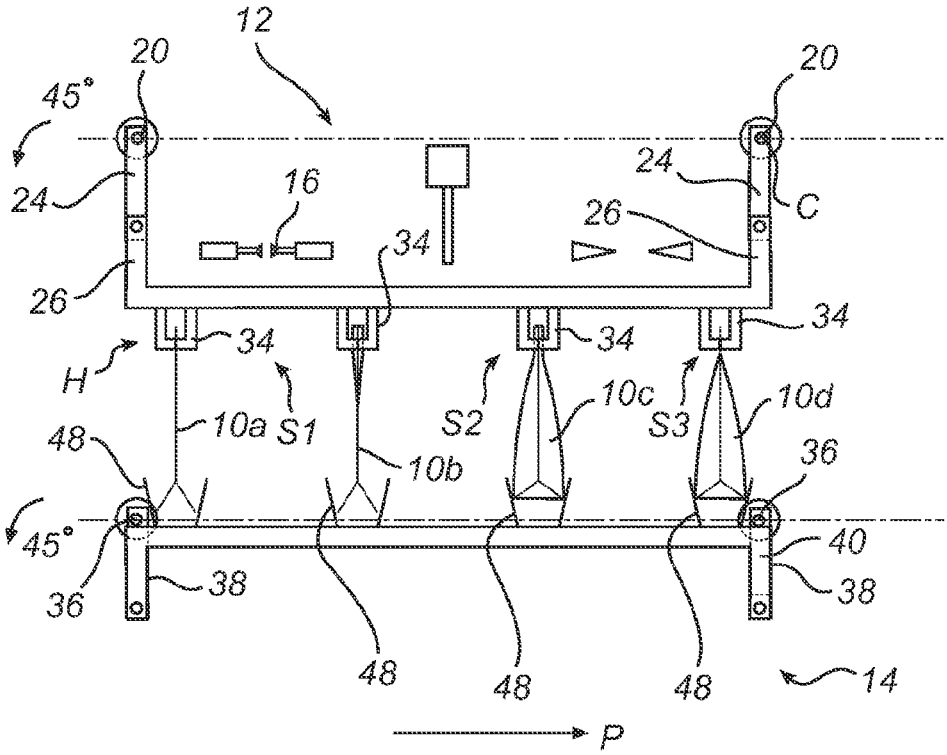
Figure 2D:
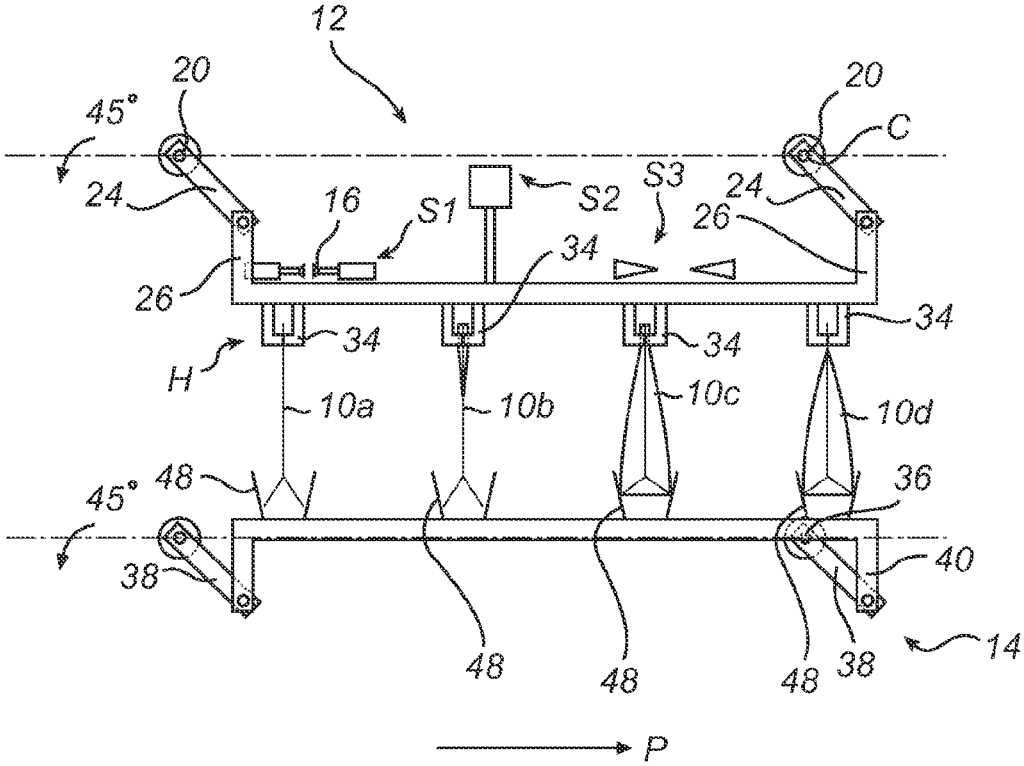

The apparatus according to the invention is designed for collecting packages 10 that have been brought to a collection position H, which is seen clearly in FIG. 2*a*, to which reference is now also made, and for intermittent (step by step) transport of the packages 10 to a respective station S1, S2, S3. The packages 10 are transported along a transport direction P which extends between the stations S1, S2, S3. Each package 10 is thus collected at the collection position H for transport to the first station S1. In the next step, the package 10 is transported to the second station S2 and, in a subsequent step, is transported to the third station S3. Finally, the package 10 is transported to a delivery position A, which is seen clearly in FIG. 2*e*, to which reference is now also made, at which delivery position A the package 10, 10*a*-10*e* is ready for further handling, for example packing in transport units (not shown).

As in the schematic embodiment shown in FIGS. 2*a*-2*h*, the first station S1 can be a station for opening a filling channel of the respective package 10. Such a station can comprise suction cups 16 that can be brought into engagement with side wall portions of the packages 10. By means of subsequent separation of the suction cups 16, while the engagement is maintained through the suction effect, a separation of said side wall portions can be produced in order to open said filling channel.

The second station S2, as in the schematic embodiment shown, can be a filling station at which a filling tube 18 is inserted into the opened filling channel of the respective package 10 in order to subsequently fill the package.

The third station S3, as in the schematic embodiment shown, can be a sealing station for closing the filled package 10.

It is also within the scope of the invention to provide other or additional stations, as is indicated in FIG. 1. Consequently, the apparatus according to the invention can comprise a gas filling station for filling a handle part of the package 10 with gas, or a gas sealing station for closing the gas-filled handle part. In the case where other or additional stations are provided, the transport unit 12 can be designed for intermittent transport of the packages also to these other or additional stations.

A holding element (not shown) for holding packages securely is arranged at each station S1, S2, S3 and positions H and A. Each holding element can be designed to handle several packages simultaneously.

The transport unit 12 is designed to transport the packages 10 in a hanging position. More specifically, the packages 10 are gripped at a top portion and thus hang down in said transport unit 12.

The packages 10 are thus moved by means of the transport unit 12 from the collection position H to the first station S1, from there to the second station S2, and then onward to the third station S3, along said transport direction P. As has been mentioned above, the packages are transported finally to the delivery position A.

The packages 10 can be moved in groups of one or more packages 10.

It will be appreciated that the packages 10 do not have to be moved only along said transport direction P, and instead it is also possible for other movement components to be provided. For example, the packages 10 can be moved between two stations along a first curved path of movement, as is the case in said schematic embodiment shown here.

According to the embodiment shown, the transport unit 12 is supported by a number of transport unit brackets 20. These transport unit brackets 20 are in turn supported by a stand 22 and are rotatably mounted in said stand 22. More specifically, each transport unit bracket 20 is designed to support the transport unit 12 at a radial distance from its centre of rotation C.

Each transport unit bracket 20 comprises a first arm 24 which extends radially outward from the respective centre of rotation C and which, at its end directed away from the centre of rotation C, is rotatably connected to a transport unit framework 26.

Said transport unit brackets 20 are rotatable by means of a first drive arrangement 28 which, for example, can comprise a first electric motor 30. As is shown in FIG. 1, the first electric motor 30 can be integrated in one of said transport unit brackets 20.

The driving of said first electric motor 30 thus rotates said transport unit brackets 20 which, via associated arms 24, cause the transport unit 12 to execute a closed cyclical and circular movement. However, the transport unit 12 is supported in such a way that it maintains a horizontal orientation during the circular movement.

During the intermittent transport of a package along the transport direction P, the package 10 is held by means of a movable gripping element 34 of the transport unit 12 provided for the delivery position A and each station S1, S2, S3. Each gripping element 34 is designed to grip a top portion of a package 10 and can be designed in the form of one or more jaws.

The gripping elements 34 are designed to pick up packages 10 when the latter are arranged at the collection position H and at the stations S1, S2, S3, and the collecting can be performed, for example, by jaws of the gripping elements 34 being activated to grip the packages 10. The driving of the first motor 30 causes the transport unit 12 and its gripping elements 34 to execute said circular movement and thus move the packages 10 along curved paths of movement. Since the transport unit 12 maintains its horizontal orientation, the gripping elements 34 also maintain their orientation. When the transport unit 12 has been moved a half turn, corresponding to a work portion of said circular movement, the packages 10, 10*a*-10*e* have been brought to the subsequent station S1, S2, S3 or to the delivery position A. The packages 10 are transferred to the holding elements (not shown) by means of the latter being activated at the same time as the jaws of the gripping elements 34 release the packages 10. Continued driving of the first motor 30 causes the transport unit 12 to continue its circular movement along a return portion, as a result of which the gripping elements 34 are returned to their starting positions.

Since the transport unit 12 is imparted a circular movement during operation of the first electric motor 30, each individual gripping element 34 is also imparted a circular movement.

A package 10 is thus moved from the collection position H to the first station S1 by means of a first of said gripping elements 34, from the first station S1 to the second station S2 by means of a second of said gripping elements 34, from the second station S2 to the third station S3 by means of a third of said gripping elements 34, and from the third station S3 to the delivery position A by means of a fourth of said gripping elements 34.

A package 10 that is gripped by a gripping element 34 and that is transported by means of said transport unit 12, during the work portion of the cyclical and circular movement thereof, is thus moved along said first curved path of movement.

The swing-inhibiting unit 14 is designed to engage with the packages 10 in order to counteract a swinging movement of these packages 10 during transport and, for this purpose, it is movable along said transport direction P while the transport unit 12 transports the packages 10. The swing-inhibiting unit 14 is designed to eliminate the swinging movement or in any event to attenuate the swinging movement so much so that spills and splashes are reduced to the necessary extent.

The swinging movement that is counteracted takes place substantially in a plane that is defined by the direction of gravitation and the transport direction P.

In the embodiment shown, the swing-inhibiting unit 14 is supported by a number of brackets 36. Said brackets 36 are in turn supported by said stand 22 and are rotatably mounted in the stand 22. More specifically, each bracket 36 is designed to support the swing-inhibiting unit 14 at a radial distance from its centre of rotation Q.

Each bracket 36 comprises a second arm 38 which extends radially outward from the respective centre of rotation Q and which, at the end directed away from the centre of rotation Q, is rotatably connected to a framework 40 of the swing-inhibiting unit 14.

Said brackets 36 are rotatable by means of a second drive arrangement 42 which, for example, can comprise a second electric motor 44. As is shown in FIG. 1, the second electric motor 44 can be integrated in one of said brackets 36.

The driving of said second electric motor 44 can thus rotate said brackets 36 which, via associated second arms 38, cause the swing-inhibiting unit 14 to execute a curved movement along a second path of movement. However, the swing-inhibiting unit 14 is supported in such a way that it maintains its horizontal orientation during operation.

In accordance with the present invention, said second electric motor 44 can be driven such that said movement is a reciprocating movement.

The swing-inhibiting unit 14 comprises an engagement element 48 for the collection position H and for each station S1, S2, S3. In the embodiment shown, each engagement element 48 comprises a pair of engagement surfaces which are angled away from each other and which are designed to engage with a bottom portion of said packages 10.

The driving of said second electric motor 44 thus causes each engagement element 48 to execute a curved reciprocating movement while maintaining its orientation.

The swing-inhibiting unit 14 is arranged at such a vertical distance from the transport unit 12 that the engagement elements 48 engage with the packages 10 in such a way that, when the latter have been filled with product, they are partially supported by the engagement elements 48. This partial supporting of the packages 10 counteracts a swinging movement. This supporting action is achieved by virtue of the angled engagement surfaces of the engagement elements 48 engaging with walls of the packages 10. The only partial support also ensures that the filled and unsealed package of the collapsible type is not pressed together by gravity to such an extent that the headspace, i.e. the free volume at the very top of the package, becomes so small that the liquid level reaches too close to the opened filling channel of the package, which would entail a risk of spillage.

The engagement elements 48 are intended to engage at least with those packages 10 that are filled but not yet sealed. This counteracts spillage from the packages 10 during transport. Advantageously, the engagement elements 48 are also designed to engage with those packages 10 that have been filled and sealed while these packages 10 are transported by means of the transport unit 12. This is to avoid a situation where the filled and closed packages strike against packages that are filled but not yet closed. It will be appreciated therefore that there may be stations at which no inhibition of a swinging movement is provided.

As has been mentioned above, the second electric motor 44 is driven such that the swing-inhibiting unit 14 is imparted a reciprocating movement. Each engagement element 48 is thus also imparted such a movement.

By ensuring that the forward curved movement of the swing-inhibiting unit 14 along said second path of movement is curved in the same direction as the circular movement of the transport unit 12, it is possible to guarantee that the engagement elements 48 of the swing-inhibiting unit 14 maintain their engagement with, and thus prevent swinging of, the packages 10 when these are being transported in said transport direction P.

FIGS. 2*a-h*, to which reference is now once again made, show schematic representations of the operation of the apparatus according to the invention and of how the transport unit 12 and the swing-inhibiting unit 14 cooperate during the transport of a package 10*a*-10*d* from the collection position H or a station S1, S2, S3 to a subsequent station S1, S2, S3 in the transport direction or to the delivery position A.

FIGS. 2*a*-2*h* illustrate the operation of an apparatus according to the invention during one cycle. The embodiment shown comprises three stations S1, S2, S3, namely an opening station S1 (at which the filling channel of a respective package is opened), a filling station S2 (at which a filling tube is inserted into the opened filling channel of the respective package in order to subsequently fill the package), and a sealing station S3 (at which the filled package is closed). Packages 10*a*-10*d* that are to be handled by the apparatus are brought to a collection position H. The packages 10*a*-10*d* that have been processed by the apparatus are finally brought to a delivery position A (at which the filled and closed packages are delivered for further handling, for example to a packing unit in which the filled packages are packed into boxes or transport units for onward transport to retailers or customers).

More specifically, FIGS. 2*a-h* illustrate four packages 10*a*-10*d* during intermittent transport in the transport direction P, from the collection position H or a station S1, S2, S3 to a subsequent station S1, S2, S3 in the transport direction P or to the delivery position A.

In FIG. 2*a*, a package 10*a* is present in its unfilled, unopened state at the collection position H, a package 10*b* is present in its unfilled, opened state at the opening station S1, a package 10*c* is present in its filled, unclosed state at the filling station S2, and a package 10*d* is present in its filled, closed state at the sealing station S3.

The gripping elements 34 have also been activated to grip a respective package 10*a*-10*d*. In addition, holding elements (not shown) have been activated to release the packages 10*a*-10*d*. It is thus possible, by moving the transport unit 12, to transport the packages 10*a*-10*d* in the transport direction P.

FIGS. 2*b-e* show the transport unit 12 and the swing-inhibiting unit 14 in positions reached by the driving of the first and second electric motors 30, 44. In each figure, the arms 24, 38 of the transport unit 12 and of the swing-inhibiting unit 14 have been turned through 45° in relation to the preceding figure. The arms 24, 38 are turned counterclockwise.

They are turned in synchrony, as a result of which the engagement elements 48 of the swing-inhibiting unit 14 are imparted a curved movement corresponding to the curved path of movement along which each package 10*a*-10*d* is moved for transport in the transport direction P. This ensures that the engagement elements 48 maintain their engagement with the respective package 10*a*-10*d*, as a result of which a swinging movement is counteracted.

More specifically, the engagement surfaces angled away from each other in the respective engagement elements 48 counteract a swinging movement of each package 10*a*-10*d* in a plane that is defined by the direction of gravity and the transport direction P. In the movement cycle illustrated in FIGS. 2*a-e*, both the transport unit 12 and also the swing-inhibiting unit 14 have a movement component along the transport direction P. Thus, the packages 10*a-d* have been transported a short distance in the transport direction P in each figure in relation to the preceding figure in FIGS. 2*a-e*.

Figure 2E:
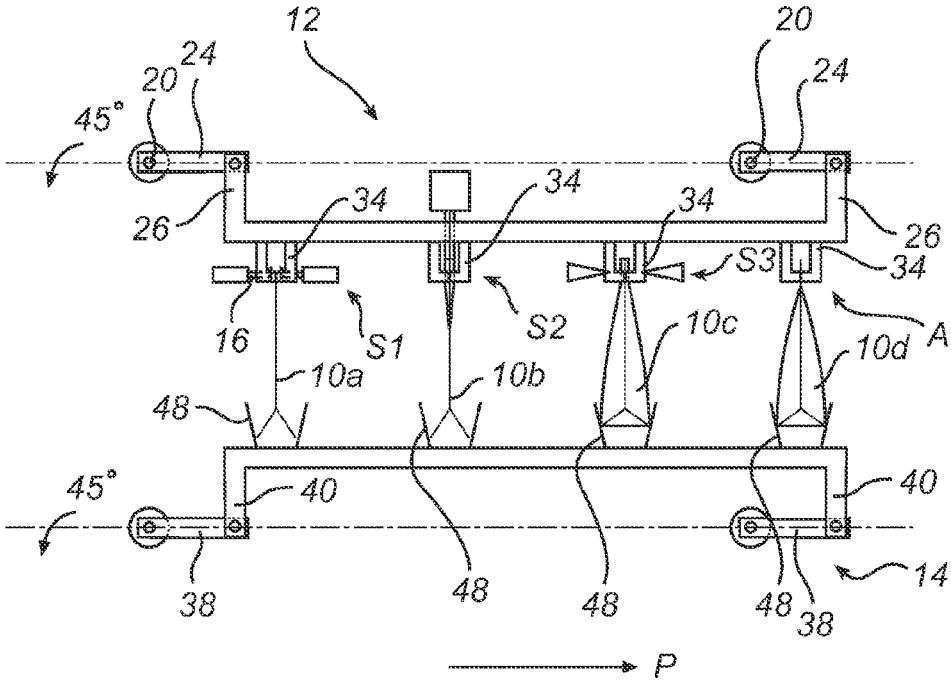

In the position shown in FIG. 2*e*, the packages 10*a-d* are transferred to the holding elements (not shown) arranged at each station S1, S2, S3 and at the delivery position A. Said holding elements, which can be designed as jaws, take hold of the packages 10*a*-10*d* via a top portion of the respective package 10*a*-10*d* in order to secure the respective package 10*a*-10*d*. When this has been done, the gripping elements 34 release the respective package 10*a*-10*d*.

It will be noted in particular how the package 10*b* which is transported to the filling station S2 is made to dock with the filling tube 18 of the filling station, which filling tube 18 can be stationary.

The various operations that are to be performed at the different stations S1, S2, S3 can now begin. Opening of the package 10*a* begins at the opening station S1, filling of the package 10*b* begins at the filling station S2, and sealing of the package 10*c* begins at the sealing station S3. The package 10*d* that has been transported to the delivery position A is ready for handling by downstream equipment.

Figure 2F:
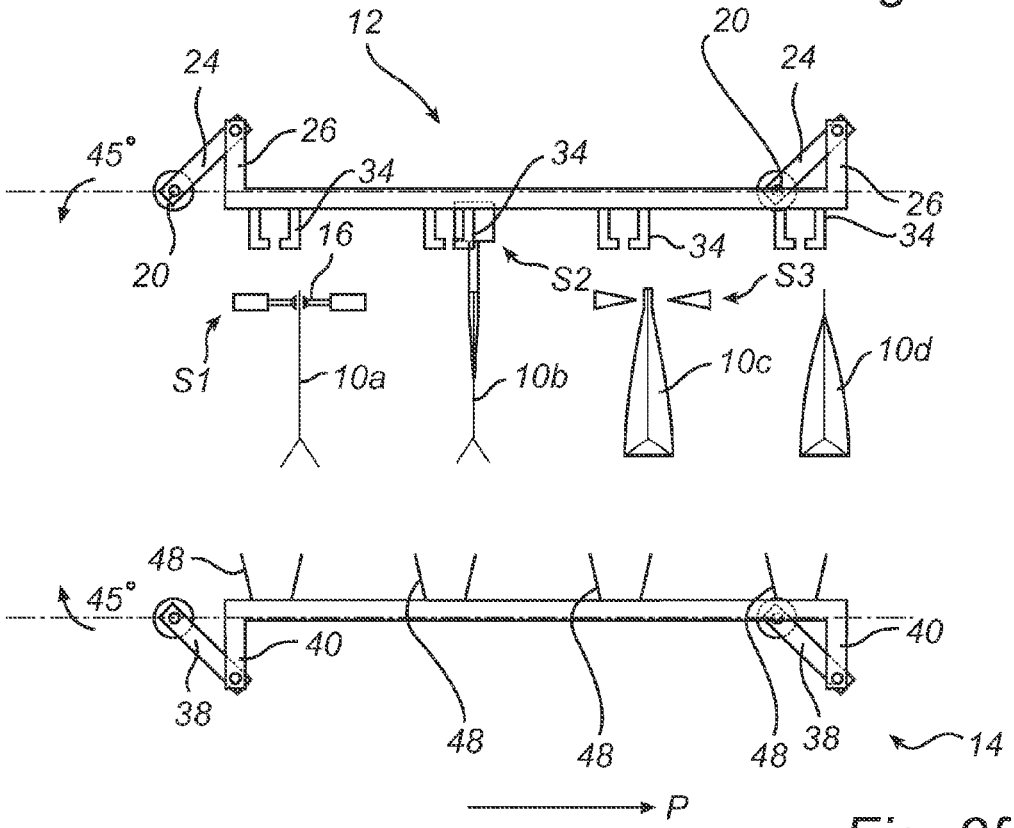
Figure 2G:
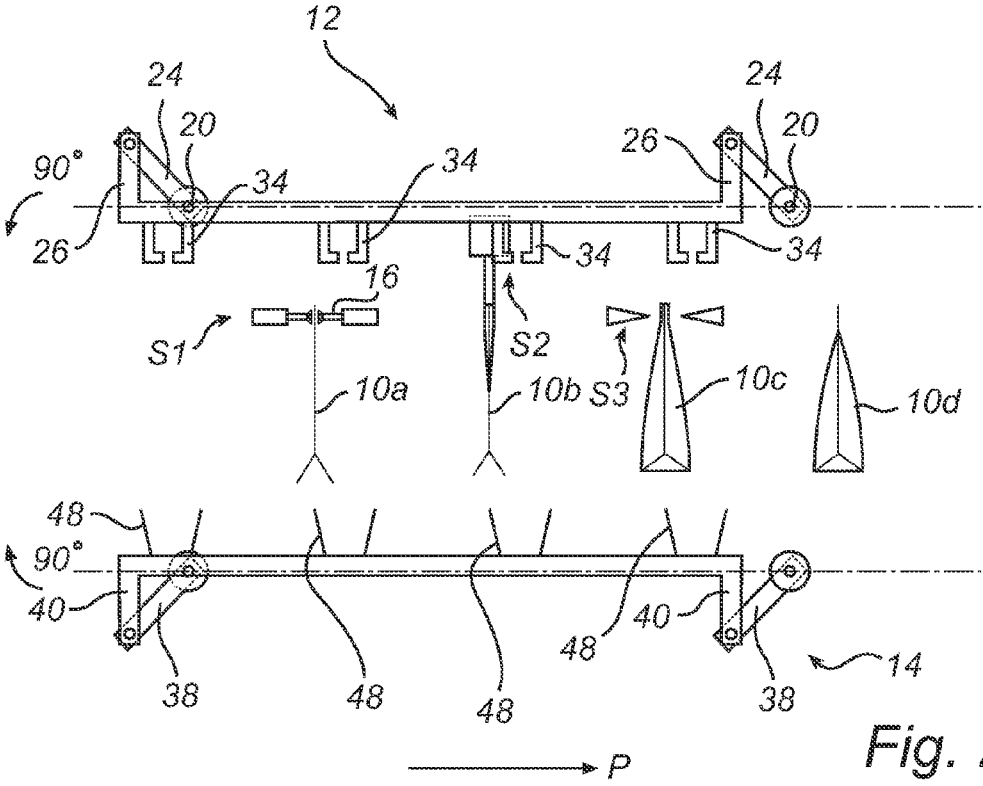

These operations take place while the transport unit 12 and the swing-inhibiting unit 14 are moved back to the positions they had in FIG. 2*a*. This movement is illustrated in FIGS. 2*f-h*.

The transport unit 12 continues its circular movement through continued counterclockwise turning of the arms 24 by means of said first motor 30. In FIGS. 2*f-h*, the arms 24 in each figure have been turned through 45° or 90° in relation to the preceding figure.

The swing-inhibiting unit 14 for its part begins its return movement, which is obtained through clockwise turning of associated arms 38 by means of the second motor 44. In FIGS. 2*f-h*, the arms 38 in each figure have been turned through 45° or 90° in relation to the preceding figure. The unit 14 therefore follows the same path of movement, but in the opposite direction.

Figure 2H:
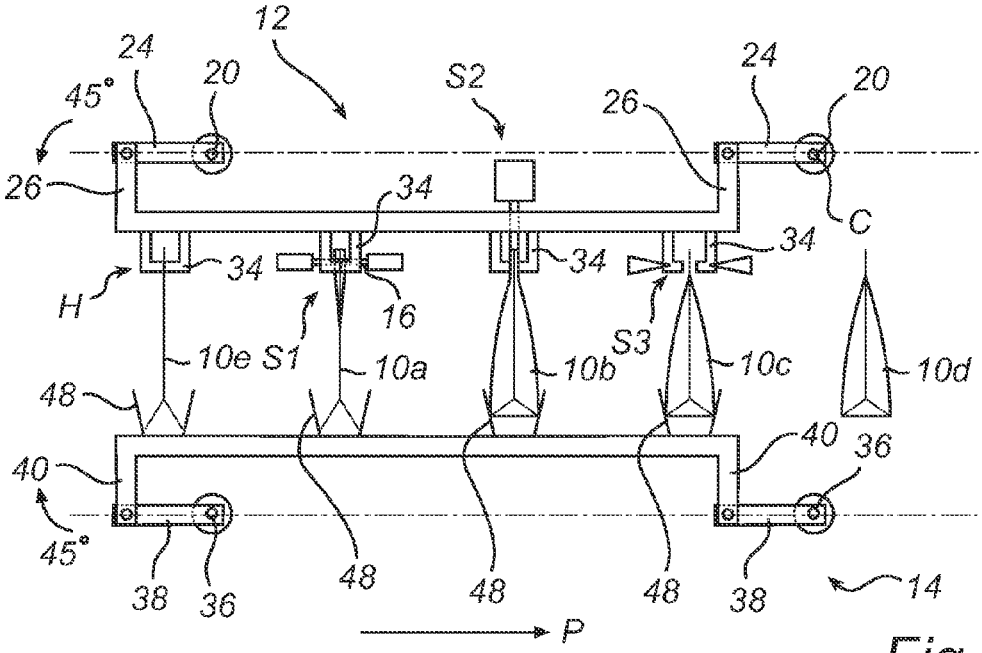

In FIG. 2*h*, the transport unit 12 and the swing-inhibiting unit 14 have been moved back to the positions they had in FIG. 2*a*. In the movement cycle illustrated in FIGS. 2*f-h*, the transport unit 12 and the swing-inhibiting unit 14 therefore have a movement component that extends in the opposite direction in relation to the transport direction P.

Thus, the movement of the transport unit 12 is described by a closed circular movement, while the movement of the swing-inhibiting unit 14 is described by an open reciprocating movement.

During the time in which the transport unit 12 and the swing-inhibiting unit 14 have been moved counter to the transport direction P, the various operations to be performed at the different stations S1, S2, S3 can be completed: the opening of the package 10*a* at the opening station S1 is completed, the filling of the package 10*b* at the filling station S2 is completed, and the sealing of the package 10*c* at the sealing station S3 is completed. Moreover, the package 10*d* at the delivery position A has been removed for further handling, for example packing.

The gripping elements 34 of the transport unit 12 can thus once again take hold of their respective package 10*a-c* and of a new package 10*e* that has been brought to the collection position H, while the holding elements (not shown) release the respective package 10*a-c*, 10*e* and the cycle can begin all over again.

The present invention is not limited to the embodiment shown.

For example, it is conceivable for the transport unit 12 and the swing-inhibiting unit 14 to be driven by one and the same motor.

It is also conceivable to drive the swing-inhibiting unit 14 such that it is imparted a circular movement. The transport unit 12 can in this case be imparted a circular movement in the counterclockwise direction, while the swing-inhibiting unit 14 is imparted a circular movement in the clockwise direction. The engagement elements 48 can in this case be in the form of vertically extending plates. The swing-inhibiting unit 14 can be driven in such a way that the plates are introduced between the packages 10, 10*a*-10*e* during transport thereof in the transport direction P and are thereafter withdrawn during the return movement.

Several modifications and variations of the apparatus according to the invention are therefore possible, for which reason the scope of the present invention is defined exclusively by the accompanying claims.

The invention claimed is:

1. An apparatus for filling packages of the collapsible type, comprising:

a first station and a second station;

a transportation unit for intermittent transport of said packages from the first station (S1) to the second station (S2) along a transport direction (P) which extends between the first station (S1) and the second station (S2), wherein the transport of the packages between the first station (S1) and the second station (S2) is along a curved first path of movement, the transportation unit being designed to transport the packages in a hanging position, and the transportation unit comprising a gripping element which is movable along a circular path and which is designed to grip a top portion of a package, each gripping element, during movement along a work portion of the circular path, serving to transport a package along the first path of movement and, during movement along a return portion of the circular path, being designed to return to a starting position for gripping a new package; and a swing-inhibiting unit which is designed to engage with the packages during said transport, the swing-inhibiting unit being movable along the transport direction (P) while the transport unit transports the packages, and the swing-inhibiting unit being arranged separately from the transport unit.

2. The apparatus according to claim 1, in which the swing-inhibiting unit comprises engagement elements which, for engagement with said packages, are located in such a way as to counteract a swinging movement in a plane that is defined by the direction of gravity and the transport direction (P).

3. The apparatus according to claim 1, in which the swing-inhibiting unit is movable along a curved second path of movement.

4. The apparatus according to claim 3, in which said second path of movement is curved in the same direction as said first path of movement.

5. The apparatus according to claim 4, in which said second path of movement is open, the swing-inhibiting unit being designed to perform a reciprocating movement along said second path of movement and the first station being arranged at a first end position of said open second path of movement and the second station being arranged at a second end position of said open second path of movement.

6. The apparatus according to claim 1, in which the swing-inhibiting unit is designed to partially support said packages during said transport.

7. The apparatus according to claim 6, in which said swing-inhibiting unit comprises engagement elements, each of which comprises a pair of engagement surfaces that are angled away from each other and that are designed to engage with a bottom portion of said packages.

8. The apparatus according to claim 1, in which the swing-inhibiting unit is movable along a curved second path of movement.

9. The apparatus according to claim 8, in which said second path of movement is curved in the same direction as said first path of movement.

10. The apparatus according to claim 9, in which said second path of movement is open, the swing-inhibiting unit being designed to perform a reciprocating movement along said second path of movement and the first station being arranged at a first end position of said open second path of movement and the second station being arranged at a second end position of said open second path of movement.

* * * * *